United States Patent [19]

Farmer

[11] 4,240,176

[45] Dec. 23, 1980

[54] WINDSHIELD CLEANING TOOL HOLDER

[75] Inventor: Michael J. Farmer, Sioux Falls, S. Dak.

[73] Assignee: Hydra Sponge Co., Inc., St. Louis, Mo.

[21] Appl. No.: 21,893

[22] Filed: Mar. 19, 1979

[51] Int. Cl.[3] ..... A47L 13/14; A47L 23/04

[52] U.S. Cl. ..... 15/121; 15/244 R

[58] Field of Search ..... 15/105, 117, 118, 121, 15/244 R, 244 A, 245, 231, 232; 411/23-27, 121, 201

[56] References Cited

U.S. PATENT DOCUMENTS

| | | | |
|---|---|---|---|
| 3,110,052 | 11/1963 | Whitman | 15/117 |
| 3,724,017 | 4/1973 | Mallory | 15/121 |
| 3,968,535 | 7/1976 | Nichols, Jr. | 15/105 |

*Primary Examiner*—Leonard D. Christian

*Attorney, Agent, or Firm*—Jerome A. Gross

[57] ABSTRACT

A pair of longitudinally extending channel members are releasably held together by clamping means, the channel members forming triangularly-shaped channels running across their upper and lower surfaces. A handle, in the form of a rod, is attached to the midpoint of one of the channel members. Cleaning tools, such as a brush, scraper, squeegee and sponge, have spines which can be inserted into the triangular channels of the channel members.

5 Claims, 3 Drawing Figures

WINDSHIELD CLEANING TOOL HOLDER

BACKGROUND AND SUMMARY OF THE INVENTION

Motorists today recognize the problems of windshield care, especially in northern latitudes in the winter where ice or snow on the windshield is a common problem. Dirty windshields are common year round and nationwide.

Presently there are available tools having a combination of an ice scraper and brush usable in the winter. There are also tools combining a squeegee and a washer for cleaning windshields. All of these tools serve a purpose, and in many instances could all be used by the same motorists. However, none of such prior art devices is adapted for interchangeably holding a brush, scraper, sponge or squeegee such that the device can be used year round and in all types of weather.

In accordance with my invention there is provided a device for interchangeably holding a plurality of windshield cleaning tools, including a sponge, scraper, squeegee and brush. The device comprises a handle, a stationary channel member, a movable matching channel member, and means for clamping the channel members together. The channel members when clamped together form substantially triangular channels running along their upper and lower surfaces. Cleaning tools are provided with spines which can be inserted into the channels prior to clamping, after which the channel members and cleaning tools can be securely clamped together.

It is a primary object of this invention to provide a holder for a variety of interchangeable windshield cleaning tools, including a sponge, squeegee, scraper and brush.

It is another object of this invention to provide a windshield cleaning tool holder which can be easily and quickly used to change from one set of cleaning tools to another.

DESCRIPTION OF PREFERRED EMBODIMENT

Briefly my invention comprises a handle having a novel holding means adapted to interchangeably hold a brush, a scraper, a sponge or a squeegee or perhaps other tools.

Figure 1:
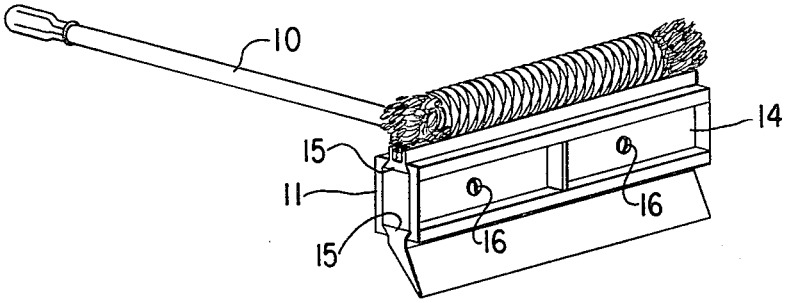
FIG. 1 is a pictorial view from the tool end of my device with a squeegee and a sponge in place.
Figure 2:
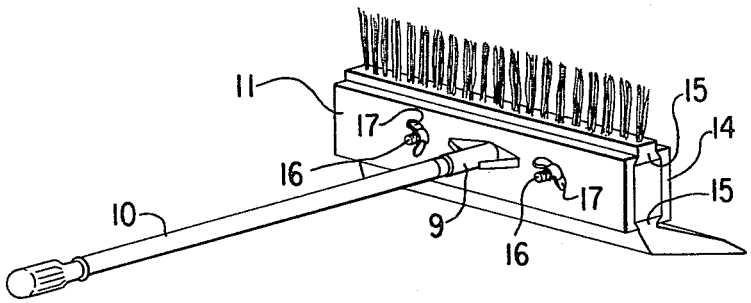
FIG. 2 is a pictorial view from the handle and showing a scraper and brush in place.
Figure 3:
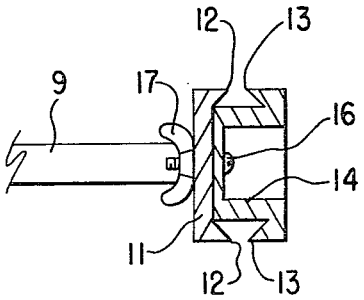
FIG. 3 is a sectional view through the attachment device.

More specifically, my device comprises a handle 10 to which is fastened a stationary fastening channel member 11. The fastening may be permanent, although I prefer to use a ferrule 9 into which the handle may be threaded with screw threads in a manner well known in the art. This channel is formed to provide a ridge 12 which matches a similar ridge 13 on the movable channel member 14. The two ridges, as best shown in FIG. 3, when pressed close together form a substantially triangular channel in which the ridges are adapted to hold a trapezoidal spine 15 on one of the various tools.

In order to provide adequate clamping action of the ridges 12 and 13 on the spine, I provide at least two bolts 16 extending through both channel members 11 and 14. The formation of the channel members as compared to the spine is such that tightening of the wing nuts 17 on the bolts 16 will clamp the ridges 12 and 13 tightly on the spine 15 of each tool. This clamping, therefore, holds each tool tightly but releasably on the handle.

The use of the tool will be obvious from the foregoing description. Any one or two of the tools can be fastened to the handle at any time. If the conditions affecting the windshield change so that the type of tool needed is changed, then simply by releasing the wing nuts 17, the grip of the ridges 12 and 13 on the spine 15 of the tool is relaxed. The spine can then be slid out from the handle and the replacement tool slipped into place. Tightening the wing nuts again will hold the new tool ready for use.

I claim:

1. A device for interchangeably holding a plurality of windshield cleaning tools, comprising:

(a) a handle in the form of a long rod;

(b) a stationary channel member attached at its midpoint to the handle;

(c) a movable matching channel member adapted to be clamped to the stationary channel member in spaced parallel relationship, both channel members having facing ridges along their upper and lower edges, the ridges slanting downwardly and to either side, and one of the channel members having a rectangularly shaped spacer portion extending into the channel portion of the other channel member, the slanting ridges and the upper and lower surfaces of the spacer portion defining substantially triangular channels running along the upper and lower surfaces of the clamped together channel members; and (d) clamping means for releasably holding together the stationary and movable channel members, such that various windshield cleaning tools having spines adapted to engage the triangular channels can be inserted into such channels and clamped between the channel members.

2. The device of claim 1 wherein the windshield cleaning tools comprise a sponge, a scraper, a squeegee and a brush.

3. The device of claim 1 wherein the substantially triangular channels are truncated and wherein the spines of the cleaning tools are trapezoidal in cross section.

4. The device of claim 1 wherein the clamping means comprise a plurality of bolts extending through both channel members and wing nuts threaded onto such bolts.

5. The device of claim 1 wherein the handle is a rod attached to the midpoint of the stationary channel member.

* * * * *